United States Patent [19]

Willis et al.

[11] Patent Number: 4,613,303

[45] Date of Patent: Sep. 23, 1986

[54] COMBUSTION AIR CONTROL IN AN IN-LINE FLAME ARRESTOR

[75] Inventors: William R. Willis; James D. Hunter, both of Tulsa; Max L. Lewis, Okmulgee, all of Okla.

[73] Assignee: Combustion Engineering, Inc., Windsor, Conn.

[21] Appl. No.: 639,612

[22] Filed: Aug. 10, 1984

Related U.S. Application Data

[63] Continuation of Ser. No. 506,961, Jun. 23, 1983, abandoned.

[51] Int. Cl.[4] ..... F23D 14/82

[52] U.S. Cl. ..... 431/346; 431/90

[58] Field of Search ..... 431/90, 89, 186, 284, 431/285, 279, 346, 354, 154, 155

[56] References Cited

U.S. PATENT DOCUMENTS

| | | | |
|---|---|---|---|
| 2,390,509 | 12/1945 | Carter | 431/154 |
| 2,418,200 | 4/1947 | Smith | 431/346 |
| 2,661,794 | 12/1953 | Shorrock | 431/90 |
| 2,689,001 | 9/1954 | Leysen | 431/89 |
| 2,758,636 | 8/1956 | Hubbard | 431/154 |
| 2,777,509 | 1/1957 | Beckett | 431/154 |
| 2,897,885 | 8/1959 | Sherman | 431/154 |
| 3,079,242 | 2/1963 | Glasgow | 431/346 |
| 3,486,458 | 12/1969 | Tyler | 431/89 |
| 3,917,242 | 11/1975 | Bass et al. | 431/155 |
| 3,918,889 | 11/1975 | Green | 431/346 |
| 4,116,617 | 9/1978 | Backman et al. | 431/155 |
| 4,184,837 | 1/1980 | Manning | 431/90 |
| 4,334,854 | 6/1982 | Graat et al. | 431/189 |
| 4,477,248 | 10/1984 | Dulac | 431/154 |

FOREIGN PATENT DOCUMENTS

| | | | |
|---|---|---|---|
| 0062316 | 10/1982 | European Pat. Off. | 431/188 |
| 2221485 | 5/1971 | Fed. Rep. of Germany | 431/284 |
| 0596167 | 12/1947 | United Kingdom | 431/90 |
| 1235891 | 6/1971 | United Kingdom | 431/90 |

*Primary Examiner*—Samuel Scott
*Assistant Examiner*—H. A. Odar

[57] ABSTRACT

Mounted on the entrance end of a firetube, the two screen elememts of an in-line flame arrestor are linearly spaced along a tubular core. A common aperture through the core wall is formed between the two screens. Combustion air directed through either, or both, screen elements enters the core through the aperture in the core wall to supply a fluid-fuel burner mounted within the core both primary and secondary portions of the combustion air. The effective size of the aperture is adjusted by a movable, internal sleeve within the core with linkage to the fuel supply system of the burner.

5 Claims, 1 Drawing Figure

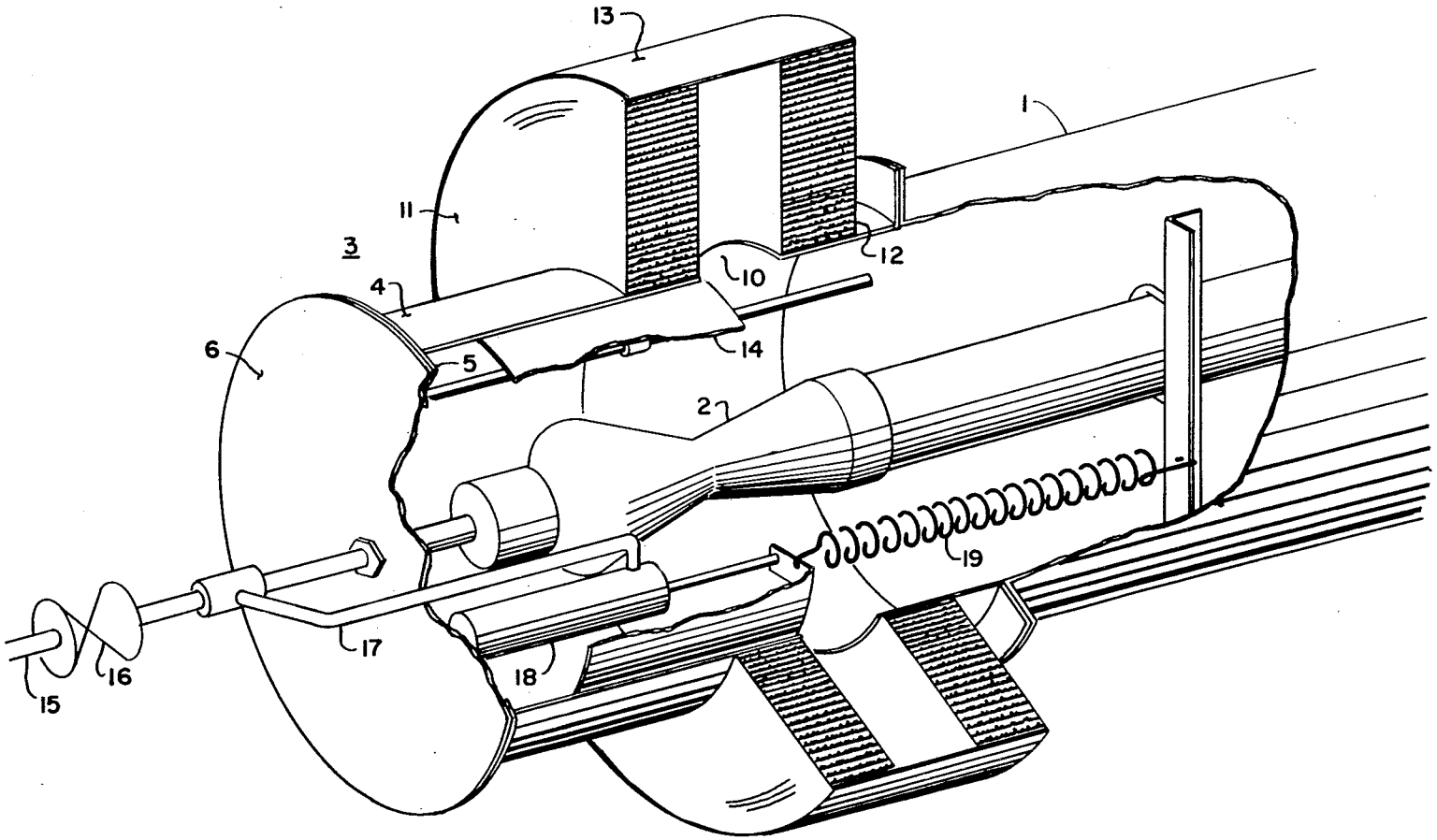
1
2
3
4
5
6
10
11
12
13
14
15
16
17
18
19

COMBUSTION AIR CONTROL IN AN IN-LINE FLAME ARRESTOR

This application is a continuation of application Ser. No. 506,961, filed June 23, 1983, now abandoned.

TECHNICAL FIELD

The present invention relates to a reorganization of the relationships between an in-line flame arrestor and burner to produce a more compact assembly readily available for inspection, repair, and replacement. More particularly, the invention relates to organizing the burner and control for its combustion air into the housing of an in-line flame arrestor to which access is improved for inspection, repair and replacement.

BACKGROUND ART

U.S. Pat. No. 3,918,889 issued Nov. 11, 1975, discloses a so-called in-line flame arrestor added as a module mounted on the burner housing which was, in turn, mounted on the end of a firetube. The thinking at that time of conception was that the spools of flame arrestor elements could be made as large in diameter as required to pass enough combustion air to supply the size of burner selected. It was contemplated that the burner protrude back through a vertical wall to pick up primary combustion air, secondary combustion air being supplied through wall openings controlled by louvers. Although there were many advantages to this arrangement, it proved somewhat awkward to link the louvers to the fluid supply. Also, the two separate modules of flame arrestor and burner housing proved somewhat awkward as an extension of structure to hang on the entrance of a firetube.

Now that the in-line type flame arrestor has been generally accepted, the awareness of the present inventors has been enlarged to encompass consolidation of the two modules, plus a gain in simplicity of access to the burner and combustion air controls for inspection, repair and replacement.

DISCLOSURE OF THE INVENTION

The present invention contemplates mounting the cylindrical core of the in-line flame arrestor as a burner housing and including control for the total air flowing into the housing for primary and secondary combustion of the burner.

The invention further contemplates the cylindrical core/housing of an in-line flame arrestor sealed at one and to the volume heated by the burner combustion and sealed by a base plate at its second end on which the burner equipment and control for the total combustion air are mounted.

The invention further contemplates an aperture in the wall of the tubular core/housing being effectively adjusted by axial movement of a cylindrical valve element within the housing linked to the fuel supplied the burner in order to parallel the fuel supply with the total combustion air.

Other objects, advantages and features of this invention will become apparent to one skilled in the art upon consideration of the written specification, appended claims, and attached drawing.

BRIEF DESIGNATION OF THE DRAWING

The drawing is a partially sectioned perspective of a flame arrestor and burner housing embodying the present invention.

BEST MODE FOR CARRYING OUT THE INVENTION

Terms and Technology

When the term "flame arrestor" is used in this disclosure it is to be understood that the basic building block of this arrestor is a spool formed by winding a strip of transversely corrugated metal paralleled by a strip of uncorrugated metal. Winding these two strips together around a cylindrical core forms what will be referred to as a screen in spool form. The corrugations provide passages of predetermined size through which combustion air will pass while effectively preventing propagation of undesirable combustion in the reverse direction of flow. In the Green U.S. Pat. No. 3,918,889, similar structures were referred to as "bodies". The terms "spool" and "screen" are now generated as more definitive in the present disclosure.

The complete flame arrestor is formed by mounting two screen spools axially aligned on the external surface of a common, or two aligned, tubular cores. Air for combustion is expected to flow through the perforations of both spools and down through a common aperture through the wall of the core or cores on which the spools are mounted. Total air for combustion is directed through the perforations of the screen spools by sealing the space between the spools with an outer sheath around their peripheries. From the volume between the spaced-apart spools, the combustion air is forced to flow down through a wall aperture in the core upon which the spools are mounted. Within the tubular core the air is divided between primary air to a fluid fuel burner mounted within the core, and secondary air to the combustion propagated by the burner. Further, in contrast to the Green U.S. Pat. No. 3,918,889, the cylindrical core is now to be formed as a housing for the burner in that this structure is to be connected at one end to whatever volume is to be heated by the burner combustion, and sealed at the other end by a base plate on which are mounted the controls for the total combustion air. The burner, pilot, and all other equipment attendant the burner, are mounted on this base plate and are removable when the plate is disconnected from the back end of the core/housing of the flame arrestor. Therefore, this type flame arrestor will be referred to as an "in-line" arrestor, being axially aligned with the firetube. With the burner mounted in the hollow cylindrical core, the control of the combustion air to the burner is exerted by a movable valve element determining the effective size of the aperture through the wall of the core for all the combustion air through the screen spools of the flame arrestor.

General Organization

In FIG. 1, a firetube 1 is disclosed as representative of all volumes into which a burner 2 delivers products of combustion. The firetube is a familiar structure in the oil field, generally having a configuration of a hairpin. The burner 2 is mounted to fire down the first leg of the elongated tube, the products of combustion flowing around the hairpin of the tube, through the second or return leg to be discharged from a stack. Although the space receiving the products of combustion is not limited to the specific form of a firetube, it will be utilized to disclose the present invention.

The fired leg of tube 1 is disclosed as elongated and cylindrical. A combined arrestor and burner housing 3 is mounted on the entrance end of the leg. The initial building block within this housing 3 is the hollow, cylindrical core 4 mounted coaxially with the fired leg of tube 1. The outer or back end 5 of core 4 mounts plate 6 and forms the base for burner 2. Disengagement of base plate 6 from the back end 5 of core 4 enables the burner, and all other structures mounted on base plate 6, to be removed from housing 3.

Aperture, or opening, 10 through the wall of core 4 provides entry for combustion air into core 4 for the combustion sustained at the output of burner 2. This combustion air is divided into two parts, the first part being the primary air going into the burner to induce the fluid fuel to mix with it in the burner, and the remainder of the combustion air to flow out and around the burner to complete the combustion.

Screen spools 11 and 12 are mounted on and sealed to the external surface of core 4 and on opposite sides of aperture 10. An external sheath 13 of housing 3 is sealed to the periphery of the spools and bridges the lateral space between the spools to force the combustion air through the screens of the spools and down through their common path through opening 10.

The present invention is concerned with controlling the effective size of opening 10 by means of a movable valve element within core 4. This movable element 14, in the form of a sleeve, is effectively positioned by the gas supply to the burner in order to automatically adjust the fuel/air ratio required for satisfactory combustion.

Operation Of Valve/Sleeve 14

Fluid fuel is supplied to the burner through conduit 15. A valve 16 in this line is opened to permit the fuel to flow to burner 2. Valve 16 is usually controlled automatically by a thermostat responsive to the temperature of the fluid heated by the combustion. This element of the control system is so conventional that detailed description would needlessly encumber disclosure of the invention. There are any number of modifying control elements, both manual and automatic, that can be applied to open, shut, or regulate valve 16 in fuel line 15. The disclosure of the invention will be better served if attention is focused upon the fact that once the fluid fuel appears down stream of valve 16, the quantity of this fuel being supplied the burner is manifested by the pressure of the fuel. The pressure of the fuel can then be applied to regulating the air necessary to combustion of that fuel.

A tube 17 is communicated with the fuel conduit 15 downstream of valve 16. Therefore, when fuel is made accessible to burner 2, its quantity is a function of the pressure in tube 17. When the pressure of fuel in tube 17 is applied to position sleeve 14 relative to aperture 10, the quantity of combustion air through aperture 10 will be regulated by the quantity of fuel supplied burner 2.

The magnitude of the pressure in tube 17 may not have sufficient power to actuate the linkage with which to apply that power to move sleeve 14. Some form of relay may be required to manipulate the fuel pressure and generate the power required for sleeve 14. However, in disclosing the invention it is necessary only to indicate that the fuel pressure, related to the quantity of the fuel, establishes the regulation of the position of sleeve 14. Therefore, the drawing simply indicates that tube 17 is connected to a piston-cylinder as a transducer of fluid pressure to mechanical motion.

A piston-cylinder 18 is mounted on base plate 6 and one side of the piston is exposed to the pressure of tube 17. The piston is connected to sleeve 14 in the arrangement whereby the pressure in tube 17 will increase the effective size of the opening provided by the aperture and sleeve 14. Again, the combustion air valve is regulated to its open position by the increase in the quantity of fuel supplied to burner 2. Finally, it is a matter of design whether the piston is connected to the sleeve with the cylinder connected to the base plate, or vice versa. In either arrangement, tube 17 is connected to the piston so as to provide the mechanical movement between the piston and cylinder which will draw sleeve 14 back from aperture 10.

The other side of the coin is the closure of this sleeve-aperture valve as the fuel pressure decreases. A spring 19 is connected between the core and sleeve 14 in the arrangement whereby a resilient force is generated to urge the sleeve to reduce the effective opening of aperture 10. The two forces are opposed. The increasing force of the fuel pressure is applied to open the valve for combustion air while being opposed by the spring which is urging the valve closed. The balance of these two forces at any one time is calibrated to supply the amount of air needed to efficiently combine with the fuel supplied for combustion.

Another detail of structure is the support and guidance for sleeve 14 as it is moved through its range within core 4. Any number of support and bearing arrangements could be provided. It will not serve the objectives of the disclosure to delineate the details of any one such form. The actual reduction to practice utilizes a series of rods extending from base plate 6 and within sleeve 14. Bearings between these rods and the sleeve function to support and guide the movement of the sleeve with only a small degree of friction to be overcome by the piston-cylinder 18 and spring 19. The important point is that all the structure within core 4 is mounted on base plate 6 so that the disconnection of plate 6 from the outer end of core 4 permits withdrawal of all the structure for service, repair and replacement.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

We claim:

1. A flame arrestor and combustion air control combination, including, an elongated cylindrical firetube into which combustion is to be propagated, a hollow cylindrical core sealed by a first end to the entrance of the firetube, a removable base plate mounted on and sealing the second end of the core, a burner mounted on the base plate and within the core as a housing to propagate combustion into the firetube, an aperture through the wall of the cylindrical core through which combustion air flows to the burner, two spools of flame arrester screen mounted on the core, one on each side of the aperture, a sheath mounted about the two screen spools and sealed to the spool peripheries to limit combustion air flow to paths through both screens and down through the common aperture between the screens and into the cylindrical core, a sleeve positioned within the cylindrical core to establish the effective size of the aperture in the path of the combustion air, a linkage between the sleeve and the base plate powered by fluid pressure to increase the size of the aperture by movement of the sleeve, a spring connected between the sleeve and the core to generate a force urging the sleeve in a direction to reduce the size of the aperture, and a connection between the sleeve and the pressure of the fuel supplied the burner as power to actuate the linkage, whereby the quantity of fluid fuel supplied the burner has its pressure applied to position the sleeve in adjustment of the quantity of air supplied the burner through the aperture to propagate the combustion by the burner.

2. The combination of claim 1, wherein, the linkage between the sleeve and base plate includes a piston/cylinder and the sleeve is connected to the fluid pressure to move the piston in the direction which will urge the sleeve to enlarge the aperture.

3. A combined flame arrestor and burner housing module with which to propagate combustion into a volume to be heated, including, a tubular core/housing mounted by a first end to propagate combustion into a space to be heated, a base plate detachably sealed to the second end of the core/housing a burner mounted on the base plate and extending within the tube toward the first end to propagate combustion into the space to be heated, a supply of fluid fuel connected to the burner, an aperture through the wall of the core/housing intermediate the first and second ends, a cylindrical sleeve slidable within the core/housing having a range of travel within the core/housing to adjust the effective opening of the aperture, a linkage between the sleeve and the base plate to position the sleeve along its range of travel, a connection between the fuel supply and the linkage to convert the pressure of the fuel supplied the burner to mechanical motion in positioning the sleeve, whereby the quantity of fuel supplied the burner as represented by the pressure regulates the amount of combustion air supplied the burner through the aperture to provide efficient combustion propagated by the burner.

4. The module of claim 3, including, a spool of screen sealed to the external surface of the core/housing, one on each side of the aperture, and a sheath sealed to the external periphery of each spool to confine access of combustion air to the aperture through the spools.

5. The module of claim 3, in which, the linkage comprises a piston/cylinder combination connected between the base plate and the sleeve and a spring between the sleeve and the core, whereby the piston/cylinder is powered by the fuel pressure to urge the sleeve to increase the opening of the aperture and is in opposition to the resilient force generated by the spring.

* * * * *